United States Patent [19]

Goldstein et al.

[11] 4,282,033

[45] Aug. 4, 1981

[54] MELTING METHOD FOR HIGH-HOMOGENEITY PRECISE-COMPOSITION NICKEL-TITANIUM ALLOYS

[75] Inventors: David Goldstein, Adelphi; Scott Hoover, Oxon Hill, both of Md.

[73] Assignee: The United States of America as represented by the Secretary of the Navy, Washington, D.C.

[21] Appl. No.: 160,050

[22] Filed: Jun. 16, 1980

[51] Int. Cl.[3] ..... C22C 19/03

[52] U.S. Cl. ..... 75/170; 75/175.5

[58] Field of Search ..... 75/170, 175.5

[56] References Cited

U.S. PATENT DOCUMENTS

| | | | |
|---|---|---|---|
| 3,174,851 | 3/1965 | Buehler et al. | 75/170 |
| 3,403,238 | 9/1968 | Buehler et al. | 337/393 |
| 3,529,958 | 9/1970 | Buehler | 75/170 |

*Primary Examiner*—R. Dean

*Attorney, Agent, or Firm*—R. S. Sciascia; A. L. Branning; R. D. Johnson

[57] ABSTRACT

A method of producing homogeneous nickel-titanium base shape change memory alloys which includes the following steps in order:

(1) converting a conventionally prepared nickel-titanium base shape change memory alloy into particles which are in the form of powder, shot, chips, or flakes;

(2) blending or mixing the nickel-titanium base alloy particles;

(3) melting the nickel-titanium base alloy particles; and (4) allowing the molten nickel-titanium base alloy to solidify into a desired shape.

7 Claims, No Drawings

MELTING METHOD FOR HIGH-HOMOGENEITY PRECISE-COMPOSITION NICKEL-TITANIUM ALLOYS

BACKGROUND OF THE INVENTION

This invention relates to metal alloys and more particularly to nickel-titanium based alloys.

Nickel-titanium alloys exhibit a shape memory effect at specific temperature depending on their precise composition. This is a well documented fact and was clearly spelled out in U.S. Pat. Nos. 3,558,369 and 3,529,958. To achieve specific transition temperatures ranges (TTR) it is necessary to maintain compositions within ±0.025% of a specified value.

It is possible to achieve this narrow compositional range by non-consumable electrode arc melting in water cooled copper hearth furnaces but casting size is limited to ingots of a pound or so. Therefore, this is not feasible for commercial production.

Consumable electrode arc melting has been used commercially to produce 100 pound ingots, but these vary in composition greatly throughout their body, well beyond the requisite ±0.025% limitation specified earlier. These variations results from gross segregation as occurs in many castings and also from trace impurities which contaminate the raw materials and which are concentrated by the zone refining effect.

Sintering of nickel and titanium powders followed by extrusion produces a fully dense product but the shape memory response is less than that of the cast and worked ingot, due to less than total homogenization which occurs during reasonable solid state consolidations.

Melting compacted nickel and titanium raw materials in a graphite susceptor is a feasible production method, but as described by Buehler, U.S. Pat. No. 3,529,958, it has certain limitations. These limitations are (1) the requirement to keep the charged melt stock (except for the starter button) free and clear of the graphite sidewalls of the melt crucible and (2) the uncertainty of final composition due to impurities in the charge materials. These seemingly minor effects are capable of producing major shifts away from the intended TTR.

It is to be noted here that chemical analysis of precise titanium content in the presence of approximately 50% titanium is accurate to only ±0.025%. Therefore, the use of wet chemical analysis is only reliable for a crude approximation of the TTR.

SUMMARY OF THE INVENTION

Accordingly, one object of this invention is to provide an improved method of preparing nickel-titanium alloys.

Another object of this invention is to provide an improved method of producing homogeneous nickel-titanium based alloys.

Still another object of this invention is to provide a method of producing highly homogeneous alloys in commercial quantities.

Yet another object of this invention is to provide a method of producing nickel-titanium based alloys of various accurate compositions.

These and other objectives of this invention are accomplished by providing a method of producing homogeneous nickel-titanium base shape change memory alloys comprising the following steps in order:

(1) converting a conventionally prepared nickel-titanium base shape change memory alloy into particles selected from the group consisting of powder, shot, chips, and flakes;

(2) blending the nickel-titanium base alloy particles;

(3) melting the nickel-titanium base alloy particles; and (4) allowing the molten nickel-titanium base alloy to solidify into a desired shape.

DETAILED DESCRIPTION OF THE PREFERRED EMBODIMENT

The process of the present invention can be used to produce homogeneous nickel-titanium shape change alloys on a commercial scale. The process comprises the following steps in order:

(1) converting a conventionally prepared nickel-titanium shape change alloy into particles selected from the group consisting of powder, shot, chips, and flakes;

(2) blending the nickel-titanium alloy particles;

(3) melting the nickel-titanium base alloy particles; and (4) allowing the molten nickel-titanium base alloy to solidify into a desired shape.

The present process is designed to work on any of the nickel-titanium shape change memory alloys. For example, highly homogeneous alloys composed of from 43.5 to 46.5 weight percent of titanium, from zero to 6 weight percent of cobalt, and the remainder being nickel may be prepared by this method. Examples of other nickel-titanium shape memory alloy which can be prepare this method can be found in U.S. Pat. No. 4,144,057, issued to Keith Melton and Oliver Mercier on Mar. 13, 1979, entitled "Shape Memory Alloys."

The starting material for step (1) can be in the form of a conventional or commercially available nickel-titanium shape memory alloy; scrap alloy may also be used.

In step (1) the alloys are formed into particles such as powder, shot, chips, or flakes. For instance, the nickel-titanium shape change memory alloy ingot can be chipped or flaked by high velocity impact again tungsten-carbide plates. Preferably shot or powder is formed from the molten alloy using shot towers, or by atomizing a stream of the molten alloy by blasting it with a stream of dry, pure inert gas. Another approach is to use a conventional spinning electrode. The shot and powder formation using molten alloy should be performed in an atmosphere of dry, pure inert gas. The size of the particles is not critical although smaller particles are preferred.

Next the nickel-titanium base alloy particles are blended in an inverted cone or other mixing machine. Particles from a single batch or from several batches may be used. In the case of a single batch, the goal is to achieve greater homogeneity. By using nickel-titanium particles of several compositions, however, an alloy with an intermediate transition temperature range (TTR) can be obtained. For example particles of nickel-titanium alloy having a TTR of 0°-10° C. can be blended with particles of a nickel-titanium alloy having a TTR of 30°-40° C. to produce an alloy having a TTR of 15°-25° C. Best results are obtained when the particles of all the batches are similar in size and shape.

Finally, in step (3) the shot blend is remelted, preferably in a graphite crucible in a vacuum induction furnace. In step (4), the melt may either be poured into a graphite mold or it may be allowed to solidify in the crucible. Alternatively, the shot alloy may be processed into ingots by sintering or other pressing techniques. These methods have not proven to be as effective as casting and hot working of production size billets, and they are apt to be costly.

The general nature of the invention having been set forth, the following example is presented as a specific illustration thereof. It will be understood that the invention is not limited to this specific example but is susceptible to various modifications that will be recognized by one of ordinary skill in the art.

EXAMPLE

Vacuum induction was used to melt an ingot of Nitinol (nickel-titanium memory alloy). A poured stream of the molten Nitinol was atomized by a blast of inert gas. The Nitinol powder formed was collected and screened as to size. Several such processings yielded powders of several different compositions. These powders could then be blended to provide intermediate compositions.

Powders of several selected compositions and their intermediates were then charged into cavities created in the walls of a graphite sleeve. The outside sleeve diameter was 3¾ inches, with wall thickness of 1⅛ inches. The cavities were drilled holes, which were 0.417 inch in diameter by 6 inches in length. A total of 11 such cavities were charged with the Nitinol powders, approximately 50 grams per cavity.

Melting of the powders was accomplished in a vacuum induction melting furnace operating at 4.3 KHz.

After melting the graphite sleeve was cooled in vacuum, the bars formed were then removed from the graphite. Very slight interaction of the molten metal with the graphite container had occurred. Upon removal of the graphite adhering to the mini-ingots (by grinding), it was apparent that the surface of all ingots had been melted. This was previously judged to have occurred by the shrinkage of the powders and appearance of a typical melting pipe in the ingot tops. Radiographic examination exhibited secondary shrinkage (voids) in the various ingots. An occasional ingot showed some incomplete melting due to insufficient time or temperature attained during the melting operation.

In the case condition the bars exhibited different sound damping characteristics at 23° C. This characteristic of Nitinol ingots is a function of their composition and has been adequately described in U.S. Pat. No. 3,174,851, entitled "Nickel-Base Alloys," which issued to William J. Buehler and Raymond C. Wiley, herein incorporated by reference.

Those bars which were sound dampening at 23° C. due to the presence of the martensitic phase became non-damping when heated to 50° C. due to their transition into the austenitic phase. This was confirmatory of the formation of Nitinol melts of different compositions, simultaneously, durng a single heating operation, since the other bars which were simultaneously melted with the sound damping bars, in separate drill holes in the same sleeve, were sound reflective at 23° C. and therefore were in the austenitic condition as melted.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A method of preparing a highly homogeneous nickel-titanium base shape change memory alloy comprising the following steps in order:
   (1) converting a consumable electrode arc melt prepared nickel-titanium base shape change memory alloy into particles selected from the group consisting of powder, shot, chips, and flakes;
   (2) blending the nickel-titanium base alloy particles;
   (3) melting the nickel-titanium base particles; and
   (4) allowing the molten nickel-titanium base alloy to solidify into a desired shape.

2. The process of claim 1 wherein in step 1 the nickel-titanium base alloy is converted into powder.

3. The process of claim 1 wherein in step 1 the nickel-titanium base alloy is converted into shot.

4. The process of claim 1, 2, or 3 wherein in step (2) particles from two or more batches of different alloy compositions are blended to achieve a mixture having the desired new composition.

5. A method of preparing a nickel-titanium base shape change memory alloy having a desired shape change transition temperature range (TTR) comprising:
   (1) blending particles of a first nickel-titanium base alloy having a TTR above the desired TTR with particles of a second nickel-titanium base alloy having a TTR below the desired TTR in a weighted proportion which will produce a third alloy having the desired TTR when the blended particles are melted; and
   (2) melting the blended particles to produce the third alloy;
   wherein the particles of the first alloy and the second alloy are selected from the group consisting of powder, shot, chips, and flakes.

6. The method of claim 5 wherein the particles are powder.

7. The method of claim 5 wherein the particles are shot.

* * * * *